US005727737A

United States Patent [19]

Bosio et al.

[11] Patent Number: 5,727,737

[45] Date of Patent: Mar. 17, 1998

[54] HORIZONTAL SIDEWALL SPRINKLER

[75] Inventors: Claude P. Bosio, New York; Thomas F. Wancho; Salvatore S. Rachiele, both of Bronx, all of N.Y.

[73] Assignee: The Reliable Automatic Sprinkler Co., Inc., Mount, Vernon, N.Y.

[21] Appl. No.: 689,254

[22] Filed: Aug. 5, 1996

[51] Int. Cl.[6] ..... B05B 1/26; A62C 37/08

[52] U.S. Cl. ..... 239/504; 239/518; 169/37

[58] Field of Search ..... 239/498, 504, 239/518, 521–524, DIG. 1; 169/37

[56] References Cited

U.S. PATENT DOCUMENTS

| | | | |
|---|---|---|---|
| 2,046,169 | 6/1936 | Knight | 239/504 |
| 3,880,239 | 4/1975 | Vorkapich | 169/37 |
| 3,904,126 | 9/1975 | Allard | 239/502 |
| 4,296,815 | 10/1981 | Mears | 169/37 |
| 4,296,816 | 10/1981 | Fischer | 169/37 |
| 4,987,957 | 1/1991 | Galaszewski | 169/37 |

*Primary Examiner*—Lesley D. Morris
*Attorney, Agent, or Firm*—Baker & Botts, L.L.P.

[57] ABSTRACT

The horizontal sidewall sprinkler has a sprinkler body with a passage having an outlet and a deflector with a vertical portion supported forwardly of the outlet by a diverging boss at the culmination of frame arms extending from the sprinkler body and a generally horizontal portion with a planar lower surface supported above the vertical portion by integral strips having a reverse curvature. The generally horizontal deflector portion is inclined upwardly from the sprinkler axis at an angle between 0.5° and 5° and the vertical deflector portion has an opening extending across the width of that portion beneath the planar surface of the horizontal portion. The vertical portion also has a central opening beneath the sprinkler axis with a forwardly directed upwardly inclined tab and two further openings on opposite sides with rearwardly directed tabs to distribute liquid in the region beneath the sprinkler.

19 Claims, 1 Drawing Sheet

HORIZONTAL SIDEWALL SPRINKLER

BACKGROUND OF THE INVENTION

This invention relates to horizontal sidewall sprinklers for distributing liquid from a sidewall of an environment which is subject to a fire hazard.

The Mears U.S. Pat. No. 4,296,815 and the Fischer U.S. Pat. No. 4,296,816 disclose a horizontal sidewall sprinkler including a deflector with a vertical portion and a generally horizontal portion connected to the vertical portion by integral side strips having a reverse curvature in which the vertical portion is formed with horizontal radial slots and includes downwardly depending tines which are bent backwardly toward the sprinkler outlet. The horizontal portion of this deflector has an upwardly deformed central section to permit water to be projected farther from the sprinkler to reach more distant regions of a protected area and the rearwardly bent tines in the vertical portion provide a converging central opening which provides spray coverage in the middle region ahead of the sprinkler from arms on which the deflector is mounted.

The sidewall sprinkler of the Galaszewksi U.S. Pat. No. 4,987,957 includes a deflector with a vertical portion connected to a horizontal portion by reversely bent integral side strips providing an opening in the vertical portion beneath the horizontal portion. The vertical portion includes upwardly inclined outwardly projecting slots and forwardly bent tabs above the slots along with rearwardly bent tines projecting downwardly from the vertical portion.

SUMMARY OF THE INVENTION

Accordingly, it is an object of the present invention to provide a sidewall sprinkler which overcomes disadvantages of the prior art.

Another object of the invention is to provide a horizontal sidewall sprinkler having a deflector producing improved distribution of fire extinguishing liquid in a region to be protected.

These and other objects of the invention are attained by providing a horizontal sidewall sprinkler with a deflector having a vertical portion attached to a sprinkler body with an outlet opening and a horizontal portion disposed above the sprinkler axis and inclined upwardly from the horizontal at a slight angle and wherein the vertical deflector portion has downwardly angled diverging slots on opposite sides of the sprinkler axis and tabs bent inwardly toward the sprinkler outlet to produce openings contiguous with the diverging slots and another tab bent outwardly away from the sprinkler outlet inclined upwardly at a slight angle from the horizontal and providing another opening in the vertical deflector portion beneath the sprinkler axis.

The slight upward inclination of the generally horizontal deflector portion and the forwardly projecting tab in the vertical portion direct liquid slightly upwardly from the sprinkler outlet toward a remote region of the area to be protected while the slots on either side of the opening in the vertical portion together with the openings formed by the inwardly directed tabs permit water to cover the protected area between the sprinkler and the remote region. The inwardly directed tabs are also effective to direct water immediately in front of the sprinkler so as to cover the floor area near the sprinkler and the wall in which the sprinkler is mounted while the tab openings and the angled slots above each of the tab openings direct liquid across the protected area farther from the sprinkler.

BRIEF DESCRIPTION OF THE DRAWINGS

Further objects and advantages of the invention will be apparent from a reading of the following description in conjunction with the accompanying drawings in which.

DESCRIPTION OF PREFERRED EMBODIMENTS

Figure 1:
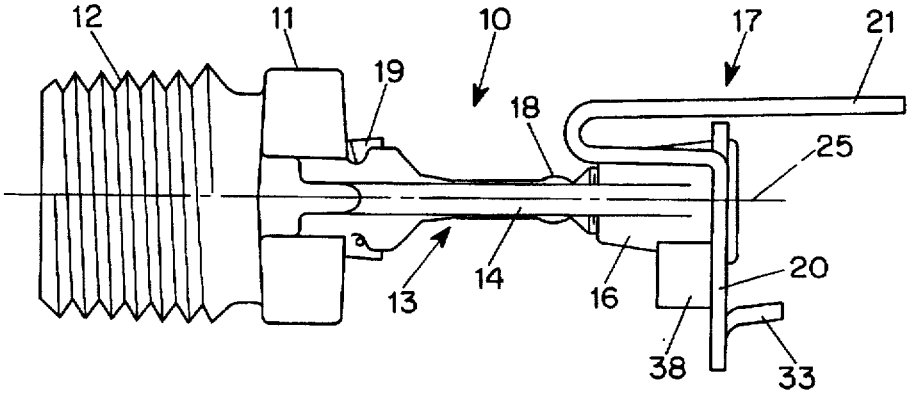
FIG. 1 is a side view showing a representative embodiment of a horizontal sidewall sprinkler in accordance with the invention.
Figure 2:
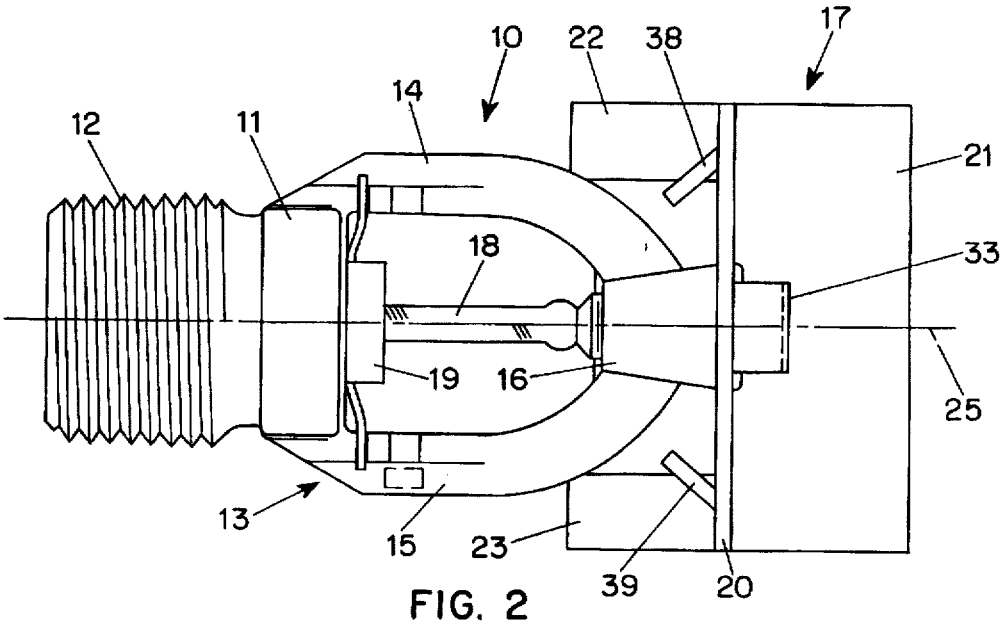
FIG. 2 is a bottom view of the sprinkler shown in FIG. 1.

In the typical embodiment of the invention illustrated in the drawings, a horizontal sidewall sprinkler 10 has a sprinkler body 11 with a threaded end 12 which is formed in the usual manner with a central passage (not visible in FIG. 1) and is adapted to be connected to a pipe in the upper portion of a sidewall of the area to be protected to supply water or other fire extinguishing fluid. At its other end, the sprinkler body is formed with a frame 13 consisting of two spaced arms 14 and 15 which are joined in a boss 16 at the end remote from the threaded end to support a deflector 17. The boss 16 has a surface which diverges from the sprinkler axis in the direction away from the threaded end. The diverging surface may have a conical shape or a parabaloidal shape. A thermally responsive element 18, such as a conventional glass bulb containing heat-expandable liquid or a conventional fusible solder element, is urged against a sealing member 19 which normally closes the liquid passage in the sprinkler body.

When the ambient temperature exceeds a predetermined value, the thermally responsive element 18 disintegrates, permitting the liquid pressure in the passage within the sprinkler body to eject the sealing member 19 so that the liquid is directed under pressure against the diverging boss 16 and deflector 17 for distribution over the area to be protected.

To provide optimum distribution of the fire extinguishing liquid over the area to be protected, the deflector 17 includes a vertical portion 20 which is affixed to the boss 16 and a generally horizontal portion 21 disposed above the vertical portion and supported therefrom by two integral strips 22 and 23 having a reverse curvature. In order to direct liquid slightly upwardly from the sprinkler passage so that it reaches a remote portion of the area to be protected, the horizontal portion 21 of the deflector is spaced above the axis 25 of the sprinkler passage by a distance equal to approximately one-half the diameter of the sprinkler passage and is inclined upwardly at a small angle of about 0.5° to 5°, preferably 1° to 3°, and desirably 1° to 2° with respect to the direction of the axis 25. In addition, the generally horizontal portion 21 has a substantially planar surface across its width in order to assure uniform distribution across the remote portion of the area to be protected.

Figure 3:
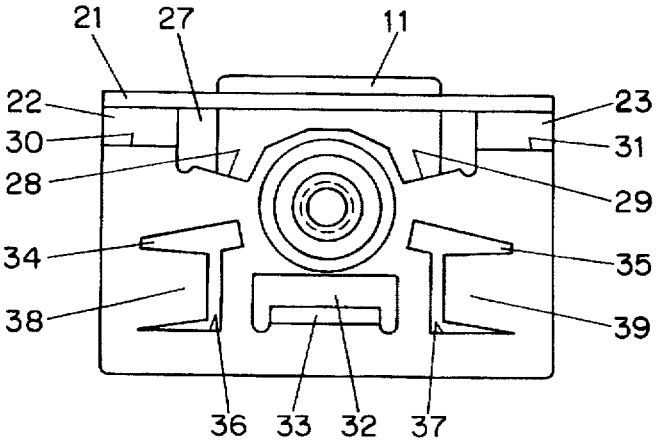
FIG. 3 is a front view of the sprinkler of FIGS. 1 and 2.

In order to facilitate distribution of liquid from the sprinkler outlet toward the remote region to be protected, the vertical deflector portion 20 has, as best seen in FIG. 3, an opening 27 above the diverging boss 16, which is defined by a generally circular edge above the boss with upwardly inclined edge portions 28 and 29 leading to two outer portions 30 and 31 where the strips 22 and 23 are joined to the vertical portion, thus permitting liquid from the sprinkler outlet to reach the planar lower surface of the generally horizontal portion 21 across the entire width of that portion.

In addition, the vertical deflector portion 20 has a central opening 32 below the sprinkler axis and a tab 33 bent forwardly from the lower edge of the opening 32 is inclined upwardly from the direction of the sprinkler axis at an angle in the range from 4° to 12°, preferably 6° to 10°, and desirably approximately 8°, the opening 32 being about one-half inch (1.25 cm.) wide and one-quarter inch (0.63 cm) high and being positioned immediately below the diverging boss 16.

To direct liquid from the sprinkler to the region intermediate between the sprinkler and the remote region of the area to be protected the vertical portion 20 of the deflector 17 is formed with two downwardly angled, outwardly diverging slots 34 and 35 equally spaced on opposite sides of the central axis of the deflector, along with contiguous generally rectangular openings 36 and 37 directly beneath the slots 34 and 35, respectively. Two tabs 38 and 39 are bent rearwardly from the outer edges of the openings 36 and 37, respectively, to distribute fire extinguishing liquid against the wall in which the sprinkler is mounted and across the region beneath the sprinkler. The tabs 38 and 39 extend rearwardly from the vertical deflector portion 20 at an angle in the range of about 25° to 65°, preferably 35° to 55°, and desirably 40° to 50°, and the openings 32 and 33 have horizontal and vertical dimension in the range from about 0.15 to 0.35 inch (0.38 to 0.89 cm.), preferably 0.2 to 0.3 inch (0.51 to 0.76 cm.), and desirably approximately 0.25 inch (0.64 cm.).

For optimum coverage, the vertical portion 20 of the deflector should preferably extend on both sides of the sprinkler axis to a distance at least equal to, and preferably two to three times, the diameter of the passage in the sprinkler body and should extend below the sprinkler axis by a distance at least equal to, and preferably at least twice, the diameter of the passage in the sprinkler body. Also, the horizontal deflector portion 21 preferably has the same width as the vertical deflector portion 20 and has a length from front to rear which is approximately equal to its width with the rear edge being spaced from the sprinkler outlet by no more than about two to four times the diameter of the sprinkler outlet opening.

The diverging boss 16, which is aligned with the sprinkler outlet passage, has a conical surface inclined inwardly toward the sprinkler axis at an angle to the sprinkler axis in the range from about 5° to about 15°, preferably 8° to about 12°, and desirably about 10°, and the maximum diameter of the boss adjacent to the vertical portion 20 of the deflector is no more than the diameter of the opening in the sprinkler passage.

With this arrangement, the deflector 17 not only assures good distribution of fire extinguishing liquid across the remote regions of the area to be protected but also provides substantially uniform distribution of the liquid across the intermediate region and the region immediately beneath the sprinkler as well as on the wall in which the sprinkler mounted.

Although the invention has been described herein with reference to specific embodiments, many modifications and variations therein will readily occur to those skilled in the art. Accordingly, all such variations and modifications are included within the intended scope of the invention.

We claim:

1. A horizontal sidewall sprinkler comprising a sprinkler body adapted to be connected to a source of fire extinguishing liquid and having a passage with an outlet of selected diameter to convey the liquid along a generally horizontal sprinkler axis, a pair of arms extending from the sprinkler body, and a deflector having a vertical portion extending substantially perpendicularly to the sprinkler axis and supported by the sprinkler arms in spaced relation to the sprinkler passage outlet and having a generally horizontal portion supported from the vertical portion at a location above the sprinkler axis, the generally horizontal portion of the deflector having a substantially planar lower surface facing the sprinkler axis and being inclined upwardly from the sprinkler axis at an angle of at least 0.5°, and the vertical deflector portion having a first opening above the sprinkler axis and beneath the horizontal deflector portion, a second opening below the sprinkler axis with a forwardly projecting tab projecting from a lower edge of the opening, and two further openings disposed below and on opposite sides of the sprinkler axis with rearwardly projecting tabs extending therefrom.

2. A horizontal sidewall deflector according to claim 1 including two strips integral with both the generally horizontal portion and the vertical portion of the deflector which extend rearwardly from opposite sides of the generally horizontal portion, each strip including a reverse curvature portion spaced rearwardly from the vertical deflector portion.

3. A horizontal sidewall sprinkler according to claim 1 wherein the pair of frame arms are disposed in a generally horizontal plane containing the sprinkler axis and wherein the second opening and the two further openings in the vertical portion of the deflector are located below the generally horizontal plane.

4. A horizontal sidewall sprinkler according to claim 1 wherein the first opening extends across the width of the vertical deflector portion beneath the generally horizontal portion of the deflector.

5. A horizontal sidewall sprinkler according to claim 1 wherein the generally horizontal portion of the deflector is inclined upwardly from the direction of the sprinkler axis at an angle in the range from about 0.5° to about 5°.

6. A horizontal sidewall sprinkler according to claim 5 wherein the generally horizontal portion of the deflector is inclined upwardly from the direction of the sprinkler axis at an angle in the range from about 1° to about 3°.

7. A horizontal sidewall sprinkler according to claim 5 wherein the generally horizontal portion of the deflector is inclined upwardly from the direction of the sprinkler axis at an angle in the range from about 1° to about 2°.

8. A horizontal sidewall sprinkler according to claim 1 wherein the forwardly inclined tab projects upwardly from the direction of the sprinkler axis at an angle in the range from about 4° to about 12°.

9. A horizontal sidewall sprinkler according to claim 8 wherein the forwardly inclined tab projects upwardly from the direction of the sprinkler axis at an angle in the range from about 6° to about 10°.

10. A horizontal sidewall sprinkler according to claim 8 wherein the forwardly inclined tab projects upwardly from the direction of the sprinkler axis at an angle of about 8°.

11. A horizontal sidewall sprinkler according to claim 1 wherein in each of the rearwardly directed tabs extends rearwardly from an outer edge of the corresponding opening in the vertical portion and is inclined from the plane of the vertical portion at an angle in the range from about 25° to about 65°.

12. A horizontal sidewall sprinkler according to claim 11 wherein each of the rearwardly directed tabs extends at an angle from the plane of the vertical portion in the range from about 35° to 55°.

13. A horizontal sidewall sprinkler according to claim 11 wherein each of the rearwardly directed tabs extends from the plane of the vertical portion at an angle in the range from about 40° to about 50°.

14. A horizontal sidewall sprinkler according to claim 1 wherein the pair of arms are joined on the sprinkler axis at a location spaced from the sprinkler passage outlet by a boss having a surface diverging outwardly in the direction away from the sprinkler passage outlet at an angle to the sprinkler axis in the range from about 5° to about 15°.

15. A horizontal sidewall sprinkler according to claim 14 wherein the diverging surface of the boss has a conical shape.

16. A horizontal sidewall sprinkler according to claim 14 wherein the diverging surface of the boss has a parabaloidal shape.

17. A horizontal sidewall sprinkler according to claim 14 wherein the maximum dimension of the boss is less than the diameter of the sprinkler passage outlet.

18. A horizontal sidewall sprinkler according to claim 3 wherein the vertical deflector portion has two internal slots extending downwardly from the generally horizontal plane and inclined outwardly on opposite sides of the sprinkler axis.

19. A horizontal sidewall sprinkler according to claim 18 wherein each of the internal slots is contiguous with one of the further openings on opposite sides of the sprinkler axis.

* * * * *